US009270062B2

(12) United States Patent
Zhou

(10) Patent No.: US 9,270,062 B2
(45) Date of Patent: Feb. 23, 2016

(54) ELECTRONIC DEVICE AND CONNECTOR DETECTION CIRCUIT THEREOF

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventor: Hai-Qing Zhou, Shenzhen (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 242 days.

(21) Appl. No.: 14/144,440

(22) Filed: Dec. 30, 2013

(65) Prior Publication Data

US 2014/0187078 A1 Jul. 3, 2014

(30) Foreign Application Priority Data

Dec. 29, 2012 (CN) ..... 2012 1 05891041

(51) Int. Cl.
*H01R 13/641* (2006.01)
*H01R 13/66* (2006.01)

(52) U.S. Cl.
CPC ..... *H01R 13/6683* (2013.01); *H01R 13/641* (2013.01)

(58) Field of Classification Search
None
See application file for complete search history.

(56) References Cited

U.S. PATENT DOCUMENTS 5,486,119 A * 1/1996 Nabeshima ..... H01R 13/641 439/364

* cited by examiner

*Primary Examiner* — Robert E Raevis
(74) *Attorney, Agent, or Firm* — Novak Druce Connolly Bove + Quigg LLP

(57) ABSTRACT

A connector detection circuit is used for detecting whether a first connector of an electronic device is in sufficient connection with a second connector of a connection device. The connector detection circuit includes a pressure sensing module, a switch unit, and an indicator. The pressure sensing module is located under the pins of the first connector, to sense whether there is pressure applied on each pin of the first connector by a corresponding pin of the second connector, and to output sensed results. The switch unit is connected to the pressure sensing module to receive the sensed results, and is connected to the indicator to control the indicator to indicate whether the first connector and the second connector have a sufficient connection with each other according to the sensed results.

16 Claims, 2 Drawing Sheets

ELECTRONIC DEVICE AND CONNECTOR DETECTION CIRCUIT THEREOF

BACKGROUND

1. Technical Field

The present disclosure relates to electronic devices, and particularly to an electronic device with a connector detection circuit.

2. Description of Related Art

Universal serial bus (USB) and serial advanced technology attachment (SATA) are popular connector communication standards used on many electronic devices. For example, a USB device or a USB data cable with a USB connector is usually connected to a computer for transmitting data. However, when the transmission of data fails, it is difficult to know whether the USB connector has an insufficient contact with the computer or whether the USB device itself is defective.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present embodiments.

DETAILED DESCRIPTION

The disclosure, including the accompanying drawings, is illustrated by way of examples and not by way of limitation. It should be noted that references to "an" or "one" embodiment in this disclosure are not necessarily to the same embodiment, and such references can mean "at least one."

Figure 1:
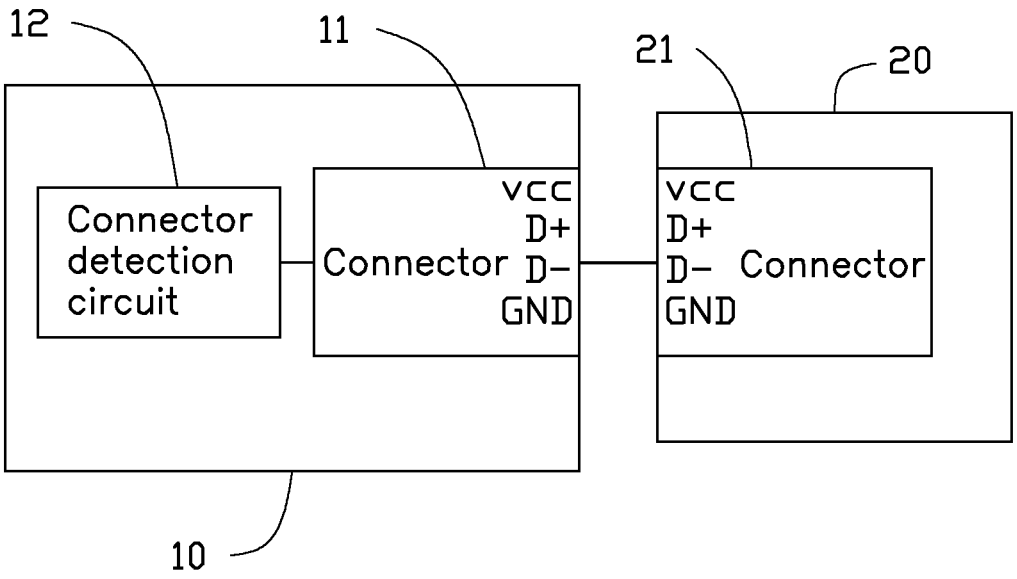
FIG. 1 is a block diagram of an embodiment of an electronic device, wherein the electronic device includes a connector detection circuit.

FIG. 1 shows an embodiment of an electronic device 10 connected to a connection device 20. The electronic device 10 comprises a connector 11 and a connector detection circuit 12. The connection device 20 comprises a connector 21. The connector detection circuit 12 detects and indicates whether the connectors 11 and 21 are completely connected after the connectors 11 and 21 have been put together. In one embodiment, each of the connectors 11 and 21 is a universal serial bus (USB) connector comprising a power pin VCC, a first data pin D+, a second data pin D−, and a ground pin GND. The electronic device 10 can be a computer or a server or other computing device, and the connection device 20 can be a hard disk drive or a data card.

Figure 2:
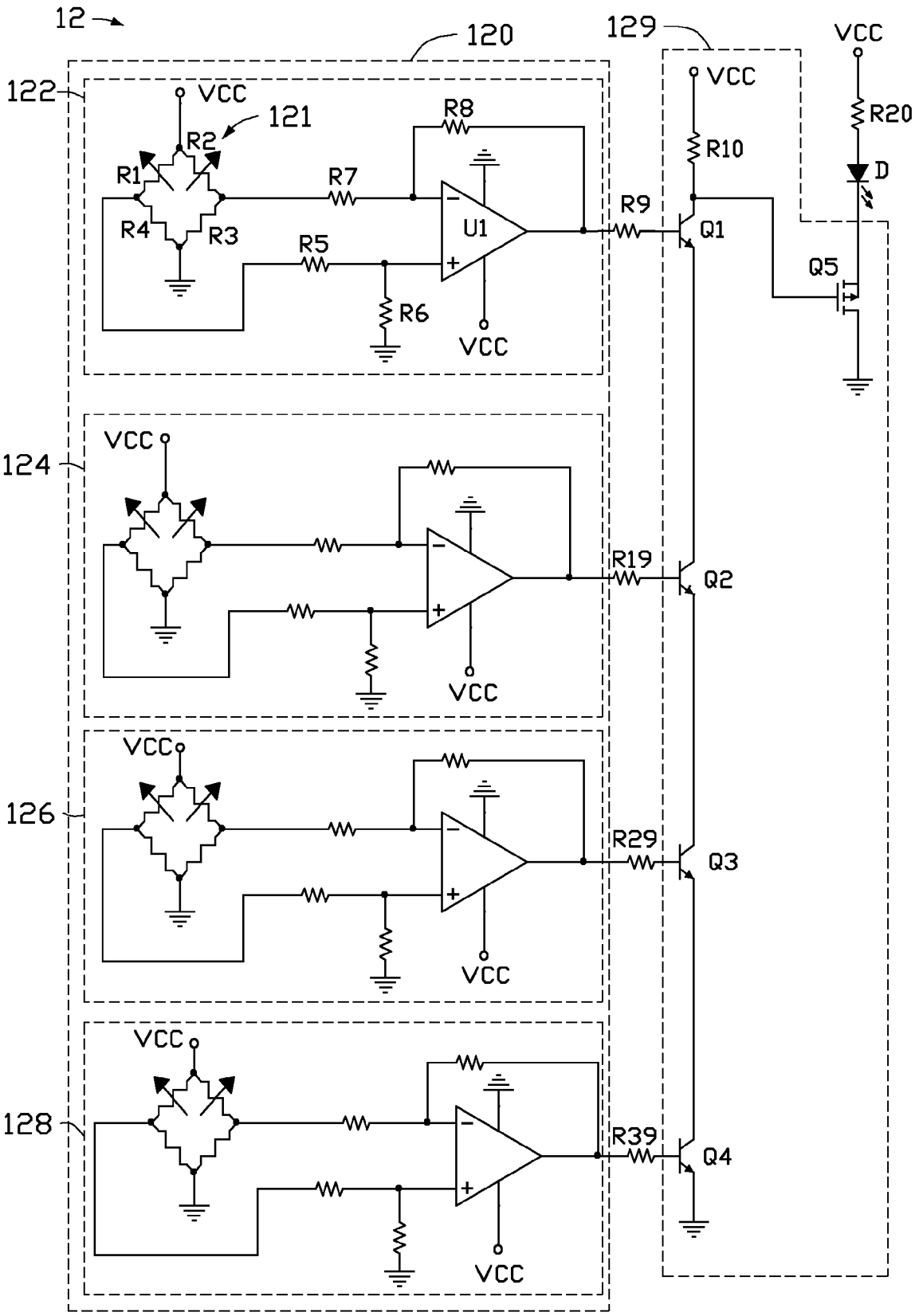
FIG. 2 is a circuit diagram of the connector detection circuit of FIG. 1.

Referring to FIG. 2, the connector detection circuit 12 comprises a pressure sensing module 120, a switch unit 129, and a light emitting diode (LED) D functioning as an indicator. The switch unit 129 is connected between the pressure sensing module 120 and the LED D. The pressure sensing module 120 is located under the power pin VCC, the first data pin D+, the second data pin D−, and the ground pin GND of the connectors 11. The pressure sensing module 120 senses whether there are proper pressures applied on the power pin VCC, the first data pin D+, the second data pin D−, and the ground pin GND of the connector 11 by their respective connections, and outputs the sensed results to the switch unit 129. The switch unit 129 controls the LED D to indicate whether the connectors 11 and 21 have a sufficient connection with each other.

The pressure sensing module 120 comprises four pressure sensing units 122, 124, 126, and 128. The pressure sensing unit 122 is located under the power pin VCC of the connector 11 and is connected to the switch unit 129. The pressure sensing unit 124 is located under the first data pin D+ of the connector 11 and is connected to the switch unit 129. The pressure sensing unit 126 is located under the second data pin D− of the connector 11 and is connected to the switch unit 129. The pressure sensing unit 128 is located under the ground pin GND of the connector 11 and is connected to the switch unit 129. The pressure sensing unit 122 senses whether there is a pressure applied on the power pin VCC of the connector 11 by the power pin VCC of the connector 21, and outputs the sensed result to the switch unit 129. The pressure sensing unit 124 senses whether there is a pressure applied on the first data pin D+ of the connector 11 by the first data pin D+ of the connector 21, and outputs the sensed result to the switch unit 129. The pressure sensing unit 126 senses whether there is a pressure applied on the second data pin D− of the connector 11 by the second data pin D− of the connector 21, and outputs the sensed result to the switch unit 129. The pressure sensing unit 128 senses whether there is a pressure applied on the ground pin GND of the connector 11 by the ground pin GND of the connector 21, and outputs the sensed result to the switch unit 129.

The pressure sensing unit 122 comprises a bridge circuit 121, an amplifier U1, and four resistors R5-R8. The bridge circuit 121 comprises four piezoresistors R1-R4. The amplifier U1 includes a non-inverting input, an inverting input, an output terminal, a power terminal, and a ground terminal. A first end of the piezoresistor R1 is connected to a power supply VCC. A second end of the piezoresistor R1 functions as a first output terminal of the bridge circuit 121 and is grounded through the piezoresistor R4. A first end of the piezoresistor R2 is connected to the power supply VCC. A second end of the piezoresistor R2 functions as a second output terminal of the bridge circuit 121 and is grounded through the piezoresistor R3. The non-inverting input of the amplifier U1 is connected to the first output terminal of the bridge circuit 121 through the resistor R5, and grounded through the resistor R6. The inverting input of the amplifier U1 is connected to the second output terminal of the bridge circuit 121 through the resistor R7. The output terminal of the amplifier U1 functions as an output terminal of the pressure sensing unit 122 and is connected to the inverting input of the amplifier U1 through the resistor R8. The power terminal of the amplifier U1 is connected to the power supply VCC. The ground terminal of the amplifier U1 is grounded.

When none of the four piezoresistors R1-R4 of the bridge circuit 121 experience pressure from the power pin VCC of the connector 11, a voltage difference between the first output and the second output of the bridge circuit 121 is zero, which means the bridge circuit 121 is balanced. A voltage of the non-inverting input of the amplifier U1 is equal to a voltage of the non-inverting input of the amplifier U1, and the output terminal of the amplifier U1 outputs a low level signal, such as logic 0.

When any one of the piezoresistors R1-R4 of the bridge circuit 122 is pressed by the power pin VCC of the connector 11, a voltage difference between the first output and the second output of the bridge circuit 121 is generated, which means that the bridge circuit 121 is unbalanced. Resistances of the piezoresistors R1-R4 and the resistors R5-R8 are preset, to make the voltage of the non-inverting input of the amplifier U1 greater than the voltage of the inverting input of the amplifier U1 when there is a voltage difference between the first output terminal and the second output terminal of the bridge circuit 121. The output terminal of the amplifier U1 thus outputs a high level signal, such as logic 1.

The circuit structure and working principle of each of the pressure sensing units 124, 126, and 128 is the same as that of the pressure sensing unit 122.

The switch unit 129 comprises five electronic switches Q1-Q5. Each of the electronic switches Q1-Q5 comprises a first terminal, a second terminal, and a third terminal The first terminal of the electronic switch Q1 is connected to the output terminal of the pressure sensing unit 122 through a resistor R9. The second terminal of the electronic switch Q1 is connected to the power supply VCC through a resistor R10. The first terminal of the electronic switch Q2 is connected to an output terminal of the pressure sensing unit 124 through a resistor R19. The second terminal of the electronic switch Q2 is connected to the third terminal of the electronic switch Q1. The first terminal of the electronic switch Q3 is connected to an output terminal of the pressure sensing unit 126 through a resistor R29. The second terminal of the electronic switch Q3 is connected to the third terminal of the electronic switch Q2. The first terminal of the electronic switch Q4 is connected to an output terminal of the pressure sensing unit 128 through a resistor R39. The second terminal of the electronic switch Q4 is connected to the third terminal of the electronic switch Q3. The third terminal of the electronic switch Q4 is grounded. The first terminal of the electronic switch Q5 is connected to the second terminal of the electronic switch Q1. The second terminal of the electronic switch Q5 is connected to a cathode of the LED D. The third terminal of the electronic switch Q5 is grounded. An anode of the LED D is connected to the power supply VCC through a resistor R20.

If the connector 21 of the connection device 20 has a sufficient connection a sufficient connection with the connector 11 of the electronic device 10 after the connector 21 is inserted in the connector 11, each pin of the connector 11 is in respective contact with each pin of the connector 21. The power pin VCC, the first data pin D+, the second data pin D−, and the ground pin GND of the connector 11 experience pressure respectively from the power pin VCC, the first data pin D+, the second data pin D−, and the ground pin GND of the connector 21. Each output terminal of the pressure sensing units 122, 124, 126, and 128 outputs a high level signal. The electronic switches Q1-Q4 are turned on. The electronic switch Q5 is turned on, because of the first terminal of the electronic switch Q5 receiving a low level signal from the second terminal of the electronic switch Q1. The LED D is lit up to indicate that the connector 11 and the connector 21 have a sufficient contact with each other.

If the connection made by the connection device 20 to the connector 11 of the electronic device 10 is less than optimal after the connector 21 is inserted to the connector 11, at least one of the pins of the connector 11 may not be in contact with the corresponding pin of the connector 21. For example, the power pin VCC of the connector 11 corresponding to the sensing unit 122 may not be in contact with the power pin VCC of the connector 21. The pressure sensing unit 122 thus cannot get a pressure reading. The output terminal of the pressure sensing unit 122 outputs a low level signal. The electronic switch Q1 stays turned off after receiving the low level signal from the output terminal of the pressure sensing unit 122. The electronic switch Q5 stays turned off because of the first terminal of the electronic switch Q5 receiving a high level signal from the second terminal of the electronic switch Q1. The LED D is not lit up, which indicates that the connector 11 does not have a sufficient connection with the connector 21.

In the embodiment, the connector detection circuit 12 detects the integrity of the connections made by the USB connectors. Each of the electronic switches Q1-Q4 is an npn-type bipolar junction transistor (BJT). The first terminal, the second terminal, and the third terminal of each of the electronic switches Q1-Q4 are a base, a collector, and an emitter of the npn-type BJT, respectively. The electronic switch Q5 is a p-channel metal-oxide semiconductor field-effect transistor (PMOSFET). The first terminal, the second terminal, and the third terminal of the electronic switch Q5 are a gate, a source, and a drain of the PMOSFET, respectively. In other embodiments, the connector detection circuit 12 detects the integrity of connection of other types of connectors, such as serial advanced technology attachment (SATA) connectors, and the number of the pressure sensing units of the pressure sensing module 120 and the number of the electronic switches of the switch unit 129 can be changed to correspond to the number of pins of the connector to be detected by the connector detection circuit 12. Each of the electronic switches Q1-Q4 can be an n-channel metal-oxide semiconductor field-effect transistor or another type of electronic switch having similar functions. The electronic switch Q5 can be a pnp-type BJT or another type of electronic switch having similar functions. The LED D can be replaced by a buzzer or other type of indicator having similar functions.

While the disclosure has been described by way of example and in terms of preferred embodiment, it is to be understood that the disclosure is not limited thereto. On the contrary, it is intended to cover various modifications and similar arrangements as would be apparent to those skilled in the art. Therefore, the range of the appended claims should be accorded the broadest interpretation so as to encompass all such modifications and similar arrangements.

What is claimed is:

1. A connector detection circuit for detecting whether a first connector of an electronic device and a second connector of a connection device are in sufficient connection with each other, each of the first connector and the second connector comprising a plurality of pins, the connector detection circuit comprising:

a pressure sensing module located under the pins of the first connector, to sense whether there is pressure applied on each pin of the first connector by a corresponding pin of the second connector, and to output sensed results;

an indicator; and a switch unit connected to the pressure sensing module to receive the sensed results from the pressure sensing module, and connected to the indicator to control the indicator to indicate whether the first connector and the second connector have a sufficient connection with each other according to the sensed results.

2. The connector detection circuit of claim 1, wherein the pressure sensing module comprises a plurality of pressure sensing units corresponding to the pins of the first connector; each pressure sensing unit is located under a corresponding pin of the first connector and is connected to the switch unit; each pressure sensing unit senses whether there is pressure applied on the corresponding pin of the first connector by a corresponding pin of the second connector, and outputs the sensed result to the switch unit.

3. The connector detection circuit of claim 2, wherein each pressure sensing unit comprises:

a bridge circuit located under a corresponding pin of the first connector and comprising:

a first piezoresistor;

a second piezoresistor;

a third piezoresistor comprising a first end connected to a power supply, and a second end functioning as a first output terminal of the bridge circuit and grounded through the first piezoresistor; and a fourth piezoresistor comprising a first end connected to the first end of the third piezoresistor, and a second end functioning as a second output terminal of the bridge circuit and grounded through the second piezoresistor;

a first resistor, a second resistor, a third resistor, and a fourth resistor; and an amplifier comprising a non-inverting input connected to the first output terminal of the bridge circuit through the first resistor and grounded through the second resistor, an inverting input connected to the second output terminal of the bridge circuit through the third resistor, and an output terminal functioning as an output terminal of a corresponding pressure sensing unit and connected to the switch unit, the output terminal further connected to the inverting input through the fourth resistor;

wherein when any one of the first to fourth piezoresistors of the bridge circuit is pressed by a corresponding pin of the first connector, a voltage difference is formed between the first output and the second output of the bridge circuit, and the output terminal of the corresponding pressure sensing unit outputs a high level signal to the switch unit; when all of the first to fourth piezoresistors of the bridge circuit are not pressed by a corresponding pin of the first connector, a voltage difference is non-existent between the first output and the second output of the bridge circuit, and the output terminal of the corresponding pressure sensing unit outputs a low level signal to the switch unit.

4. The connector detection circuit of claim 3, wherein the pressure sensing module comprises a first pressure sensing unit, a second pressure sensing unit, a third pressure sensing unit, and a fourth pressure sensing unit, in response to each of the first connector and the second connector comprising four pins; the switch unit comprises:

a fifth resistor;

a first electronic switch comprising a first terminal connected to the output terminal of the first pressure sensing unit, a second terminal connected to a power supply through the fifth resistor, and a third terminal;

a second electronic switch comprising a first terminal connected to the output terminal of the second pressure sensing unit, a second terminal connected to the third terminal of the first electronic switch, and a third terminal;

a third electronic switch comprising a first terminal connected to the output terminal of the third pressure sensing unit, a second terminal connected to the third terminal of the second electronic switch, and a third terminal;

a fourth electronic switch comprising a first terminal connected to the output terminal of the fourth pressure sensing unit, a second terminal connected to the third terminal of the third electronic switch, and a third terminal grounded; and a fifth electronic switch comprising a first terminal connected to the second terminal of the first electronic switch, a second terminal connected to the indicator, and a third terminal grounded;

wherein when all of the output terminals of the first to fourth pressure sensing units output a high level signal, the first to fifth electronic switches are turned on; when any one of the output terminals of the first to fourth pressure sensing units outputs a low level signal, the fifth electronic switch is turned off.

5. The connector detection circuit of claim 4, wherein each of the first to fourth electronic switches is an npn-type bipolar junction transistor (BJT), and the first terminal, the second terminal, and the third terminal of each of the first to fourth electronic switches are a base, a collector, and an emitter of the npn-type BJT, respectively.

6. The connector detection circuit of claim 4, wherein the indicator comprises a first terminal connected to the second terminal of the fifth electronic switch, and a second terminal connected to the power supply through a sixth resistor, when the fifth electronic switch is turned on, the indicator indicates the first connector and the second connector have a sufficient connection with each other; when the fifth electronic switch is turned off, the indicator indicates the first connector does not have a sufficient connection with the second connector.

7. The connector detection circuit of claim 6, wherein the fifth electronic switch is a p-channel metal-oxide semiconductor field-effect transistor (PMOSFET), and the first terminal, the second terminal, and the third terminal of the fifth electronic switch are a gate, a source, and a drain of the PMOSFE, respectively.

8. The connector detection circuit of claim 6, wherein the indicator is a light emitting diode (LED), and the first terminal and the second terminal of the indicator are a cathode and an anode of the LED.

9. An electronic device connected to a first connector of a connection device, the electronic device comprising:

a second connector comprising a plurality of pins corresponding to a plurality of pins of the first connector; and a connector detection circuit for detecting whether the second connector and the first connector of are in sufficient connection with each other; the connector detection circuit comprising:

a pressure sensing module located under the pins of the second connector, to sense whether there is pressure applied on each pin of the second connector by a corresponding pin of the first connector, and to output sensed results;

an indicator; and a switch unit connected to the pressure sensing module to receive the sensed results from the pressure sensing module, and connected to the indicator to control the indicator to indicate whether the first connector and the second connector have a sufficient connection with each other according to the sensed results.

10. The electronic device of claim 9, wherein the pressure sensing module comprises a plurality of pressure sensing units corresponding to the pins of the second connector; each pressure sensing unit is located under a corresponding pin of the second connector and connected to the switch unit; each pressure sensing unit senses whether there is pressure applied on the corresponding pin of the second connector by a corresponding pin of the first connector, and outputs a sensed result to the switch unit.

11. The electronic device of claim 10, wherein each pressure sensing unit comprises:

a bridge circuit located under a corresponding pin of the first connector and comprising:

a first piezoresistor;

a second piezoresistor;

a third piezoresistor comprising a first end connected to a power supply, and a second end functioning as a first output terminal of the bridge circuit and grounded through the first piezoresistor; and a fourth piezoresistor comprising a first end connected to the first end of the third piezoresistor, and a second end functioning as a second output terminal of the bridge circuit and grounded through the second piezoresistor;

a first resistor, a second resistor, a third resistor, and a fourth resistor; and an amplifier comprising a non-inverting input connected to the first output terminal of the bridge circuit through the first resistor and grounded through the second resistor, an inverting input connected to the second output terminal of the bridge circuit through the third resistor, and an output terminal functioning as an output terminal of a corresponding pressure sensing unit and connected to the switch unit, the output terminal further connected to the inverting input through the fourth resistor;

wherein when any one of the first to fourth piezoresistors of the bridge circuit is pressed by a corresponding pin of the first connector, a voltage difference is formed between the first output and the second output of the bridge circuit, and the output terminal of the corresponding pressure sensing unit outputs a high level signal to the switch unit; when all of the first to fourth piezoresistors of the bridge circuit are not pressed by a corresponding pin of the first connector, a voltage difference is non-existent between the first output and the second output of the bridge circuit, and the output terminal of the corresponding pressure sensing unit outputs a low level signal to the switch unit.

12. The electronic device of claim 11, wherein the pressure sensing module comprises a first pressure sensing unit, a second pressure sensing unit, a third pressure sensing unit, and a fourth pressure sensing unit, in response to each of the first connector and the second connector comprising four fins; the switch unit comprises:

a fifth resistor;

a first electronic switch comprising a first terminal connected to the output terminal the first pressure sensing unit, a second terminal connected to a power supply through the fifth resistor, and a third terminal;

a second electronic switch comprising a first terminal connected to the output terminal of the second pressure sensing unit, a second terminal connected to the third terminal of the first electronic switch, and a third terminal;

a third electronic switch comprising a first terminal connected to the output terminal of the third pressure sensing unit, a second terminal connected to the third terminal of the second electronic switch, and a third terminal;

a fourth electronic switch comprising a first terminal connected to the output terminal of the fourth pressure sensing unit, a second terminal connected to the third terminal of the third electronic switch, and a third terminal grounded; and a fifth electronic switch comprising a first terminal connected to the second terminal of the first electronic switch, a second terminal connected to the indicator, and a third terminal grounded;

wherein when all of the output terminals of the first to fourth pressure sensing units output a high level signal, the first to fifth electronic switches are turned on; when any one of the output terminals of the first to fourth pressure sensing units outputs a low level signal, the fifth electronic switch is turned off.

13. The electronic device of claim 12, wherein each of the first to fourth electronic switches is an npn-type bipolar junction transistor (BJT), and the first terminal, the second terminal, and the third terminal of each of the first to fourth electronic switches are a base, a collector, and an emitter of the npn-type BJT respectively.

14. The electronic device of claim 12, wherein the indicator comprises a first terminal connected to the second terminal of the fifth electronic switch, and a second terminal connected to the power supply through a sixth resistor, when the fifth electronic switch is turned on, the indicator indicates the first connector and the second connector have a sufficient connection with each other; when the fifth electronic switch is turned off, the indicator indicates the second connector does not have a sufficient connection with the first connector.

15. The electronic device of claim 14, wherein the fifth electronic switch is a p-channel metal-oxide semiconductor field-effect transistor (PMOSFET), and the first terminal, the second terminal, and the third terminal of the fifth electronic switch are a gate, a source, and a drain of the PMOSFET respectively.

16. The electronic device of claim 14, wherein the indicator is a light emitting diode (LED), and the first terminal and the second terminal of the indicator are a cathode and an anode of the LED.

* * * * *